US005151254A

United States Patent [19]

Arai et al.

[11] Patent Number: 5,151,254

[45] Date of Patent: Sep. 29, 1992

[54] EXHAUST GAS CLEANING DEVICE FOR INTERNAL COMBUSTION ENGINE

[75] Inventors: Hideki Arai; Makoto Kawai; Kenji Miyai, all of Shizuoka, Japan

[73] Assignee: Suzuki Jidosha Kogyo Kabushiki Kaisha, Japan

[21] Appl. No.: 573,753

[22] Filed: Aug. 28, 1990

[30] Foreign Application Priority Data

| | | | |
|---|---|---|---|
| Aug. 29, 1989 | [JP] | Japan | 1-220264 |
| Aug. 29, 1989 | [JP] | Japan | 1-220265 |
| Aug. 29, 1989 | [JP] | Japan | 1-220266 |
| Aug. 29, 1989 | [JP] | Japan | 1-220267 |
| Aug. 29, 1989 | [JP] | Japan | 1-220268 |

[51] Int. Cl.[5] ..... F01N 3/10

[52] U.S. Cl. ..... 422/180; 422/181; 422/218; 422/222; 55/486; 55/523; 55/524; 55/DIG. 30; 60/299; 60/302; 181/248; 181/258; 181/267; 181/290

[58] Field of Search ..... 422/180, 181, 218, 222, 422/211; 181/248, 258, 267, 290; 55/486, 522, 523, 524, DIG. 30; 60/299, 302

[56] References Cited

U.S. PATENT DOCUMENTS

| | | | |
|---|---|---|---|
| 4,728,503 | 3/1988 | Iida et al. | 422/169 |
| 5,012,642 | 5/1991 | Laimbock | 60/299 |
| 5,014,510 | 5/1991 | Laimbock | 60/299 |

*Primary Examiner*—Lynn M. Kummert
*Attorney, Agent, or Firm*—Finnegan, Henderson, Farabow, Garrett and Dunner

[57] ABSTRACT

An exhaust gas cleaning device is disposed within an exhaust pipe connected to the exhaust port of an internal combustion engine. The exhaust gas cleaning device comprises an inner pipe disposed coaxially within the exhaust pipe with an annular space defined therebetween, the inner pipe being provided with a plurality of perforations, and laminated structures disposed upon the inner and outer surfaces of the inner pipe and including a catalyst for cleaning unburned components of the exhaust gas flowing within the exhaust pipe, each of the laminated structures being formed of a material which is not deleterious to the catalyst. The laminated structure includes a catalyst carrier layer formed by, in accordance with one method, fusibly injecting a catalyst including a solution onto an intermediate layer formed upon the inner and outer surfaces of the inner pipe and drying the same so as to remove the liquid component therefrom. The laminated structure may also be formed upon the inner surface of the exhaust pipe so as to improve the exhaust gas cleaning effect.

17 Claims, 4 Drawing Sheets

EXHAUST GAS CLEANING DEVICE FOR INTERNAL COMBUSTION ENGINE

FIELD OF THE INVENTION

The present invention relates to an exhaust gas cleaning device disposed within an exhaust pipe of an internal combustion engine for cleaning unburned components contained within the exhaust gas.

BACKGROUND OF THE INVENTION

An internal combustion engine mounted upon an automobile, for example, is provided with an exhaust port to which an exhaust manifold is connected. The exhaust gases discharged from the combustion chamber of the internal combustion engine generally include unburned components. A catalyst member formed by laminating a suitable catalyst upon a ceramic carrier having a honeycomb shape is attached to the manifold. The exhaust gases flow into the manifold and, while flowing there-through, the exhaust gases are subjected to an oxidation reaction as a result of being disposed in contact with the catalyst member whereby the unburned components within the exhaust gases are cleaned or effectively removed therefrom.

In connection with an internal combustion engine having a small size and mounted upon a vehicle such as, for example, a motorcycle, an exhaust pipe is connected to the exhaust port of the engine, and a catalyst member having a honeycomb composition or structure, for example, and formed by laminating or adhering catalyst upon a cloth material such as, for example, glass wool, is disposed upon an inner surface of the exhaust pipe by utilizing a press plate, for example. The unburned components of the exhaust gases discharged from the combustion chamber of the engine are therefore forced into contact with the catalyst member whereby the unburned components of the exhaust gases are effectively cleaned or removed from the exhaust gases through means of the aforenoted oxidation reaction. These conventional techniques are disclosed within, for example, Japanese Patent Publication No. 59-1324 and Japanese Patent Laid-open Publication No. 61-96120.

However, with respect to the catalyst having a honeycomb structure since the exhaust gases pass through a plurality of perforations formed within the honeycomb catalyst member, the flow region for the exhaust gases is reduced and the exhaust gas flow is influenced by means of the resistance defined by means or characteristic of the catalyst member having the honeycomb structure. This fact results in the lowering of the output of the engine and, particularly, with respect to a small sized engine, the lowering of the output adversely affects the engine performance. Moreover, the location of such honeycomb catalyst member within the manifold enlarges the total size of the manifold, such being undesirable in connection with the construction and the manufacturing costs thereof. Furthermore, the adherence of the catalyst member made of cloth material to the inner surface of the exhaust pipe involves the problem of the adherence thereof as well as increased costs in addition to the problem of performance or durability of the engine itself.

SUMMARY OF THE INVENTION

An object of the present invention is to substantially eliminate the defects or drawbacks encountered within the prior art described above and to provide an exhaust gas cleaning device having a simple structure and which is capable of effectively cleaning the exhaust gases disposed in contact with a catalyst means and improving the durability and performance of the engine.

SUMMARY OF THE INVENTION

This and other objects can be achieved according to the present invention, in accordance with one aspect, by providing an exhaust gas cleaning device disposed within thereof an exhaust pipe of an internal combustion engine, and comprising an inner pipe disposed coaxially within the exhaust pipe with an annular space defined between an outer surface of the inner pipe and an inner surface of the exhaust pipe, the inner pipe being provided with a plurality of perforations and laminated structures disposed upon the inner and outer surfaces of the inner pipe and including a catalyst for cleaning the unburned components of the exhaust gases flowing within the exhaust pipe, each of the laminated structures being formed of a material which is not detrimental to the catalyst.

In accordance with preferred embodiments, the laminated structures include first layers formed of a material having a properties which are not detrimental to the catalyst disposed upon the inner and outer surfaces of the inner pipe, and second layers formed upon the outer surfaces of the first layers as catalyst carrier layers, the second layers being formed by injecting a slurry composed of a catalyst solution and a catalyst carrier, and subsequently drying the injected slurry so as to remove the liquid component therefrom. The outer surface of the first layer is formed so as to exhibit an irregular surface provided with recessed and protruding portions.

In accordance with a modification of the aforenoted embodiment, the inner and outer surfaces of the inner pipe are formed so as to have irregular surfaces provided with recessed and protruding portions, and the laminated structures are formed of catalyst carrier layers disposed upon the irregular inner and outer surfaces of the inner pipe by fusibly injecting a slurry composed of a catalyst solution and a catalyst carrier, and drying the injected slurry so as to remove the liquid component therefrom.

In accordance with another aspect of the present invention, there is provided an exhaust gas cleaning device disposed within an exhaust pipe of an internal combustion engine, comprising an inner pipe disposed coaxially within the exhaust pipe with a space defined between the outer surface of the inner pipe and the inner surface of the exhaust pipe, the inner pipe being provided with a plurality of perforations and laminated structures disposed upon inner and outer surfaces of the inner pipe, the laminated structures each comprising an intermediate film layer which is not detrimental to a catalyst and being formed upon the inner and outer surfaces of the inner pipe, and a catalyst carrier layer formed upon the outer surface of the intermediate film layer, the catalyst carrier layer being formed by injecting a metallic oxide upon the outer surface of the intermediate film layer so as to form a catalyst layer, impregnating a catalyst solution into the catalyst layer, and then drying the catalyst layer so as to remove the liquid component therefrom.

In accordance with a further aspect of the present invention, there is provided an exhaust gas cleaning device, comprising an inner pipe disposed coaxially within the exhaust pipe with a space defined between the outer surface of the inner pipe and the inner surface of the exhaust pipe, the inner pipe being provided with a plurality of perforations and laminated structures disposed upon inner and outer surfaces of the inner pipe, the laminated structures comprising catalyst carrier layers including a plurality of holes and being formed upon the inner and outer surfaces of the inner pipe, the catalyst carrier layers being formed by fusibly injecting a metallic oxide upon the inner and outer surfaces of the inner pipe so as to form catalyst layers which include holes, impregnating a catalyst solution into the catalyst layers, and then drying the catalyst layers so as to remove the liquid component therefrom.

In accordance with a still further aspect of the present invention, there is provided gas cleaning device disposed within the exhaust pipe of an internal combustion engine, comprising an inner pipe disposed coaxially within the exhaust pipe with a space defined between the outer surface of the inner pipe and the inner surface of the exhaust pipe, the inner pipe being provided with a plurality of perforations and laminated structures disposed upon inner and outer surfaces of the inner pipe, the laminated structures being composed of carrier layers formed by injecting alumina upon the inner and outer surfaces of the inner pipe, and catalyst means adhered to the outer surfaces of the carrier layers.

In accordance with the described embodiments, the laminated structure may also be formed upon the inner surface of the exhaust pipe.

According to the present invention having the characteristics described above, the inner pipe serving as the catalyst support means is provided with a plurality of perforations for ventilation, so that the exhaust gases flowing within the exhaust pipe pass into the inner pipe through means of the perforations and into contact with the catalyst layers formed upon the outer and inner surfaces of the inner pipe. The catalyst layers are formed so as not to directly contact the inner pipe, there being provided, for example, a metallic intermediate layer having properties which are not detrimental to the catalyst. When disposed in contact with the catalyst, the unburned components of the exhaust gases are subjected to the oxidation reaction so as to clean or remove the same with respect to or from the exhaust gases. The inner pipe is coaxially disposed within the exhaust pipe with a space defined therebetween, and the catalyst layer is formed thereon, so that the flow of the exhaust gas therethrough does not encounter any substantial resistance or interference, thus improving the durability and performance of the engine itself in comparison with a conventional engine provided with a conventional exhaust gas cleaning means. The location of the intermediate layer between the catalyst carrier layer and the outer surface of the inner pipe may lessen the thermal shocks and thermal strains due to the various heat cycles that the exhaust system experiences. In addition, the fusible injection process may form holes within the catalyst carrier layer and the density of the catalyst can be optionally selected by preparing the catalyst solution.

BRIEF DESCRIPTION OF THE DRAWINGS

Various other objects, features, and attendant advantages of the present invention will become more fully appreciated from the following detailed description when considered in connection with the accompanying drawings, in which like reference characters designate like or corresponding parts throughout the several views, and wherein.

DESCRIPTION OF THE PREFERRED EMBODIMENTS

Figure 1:
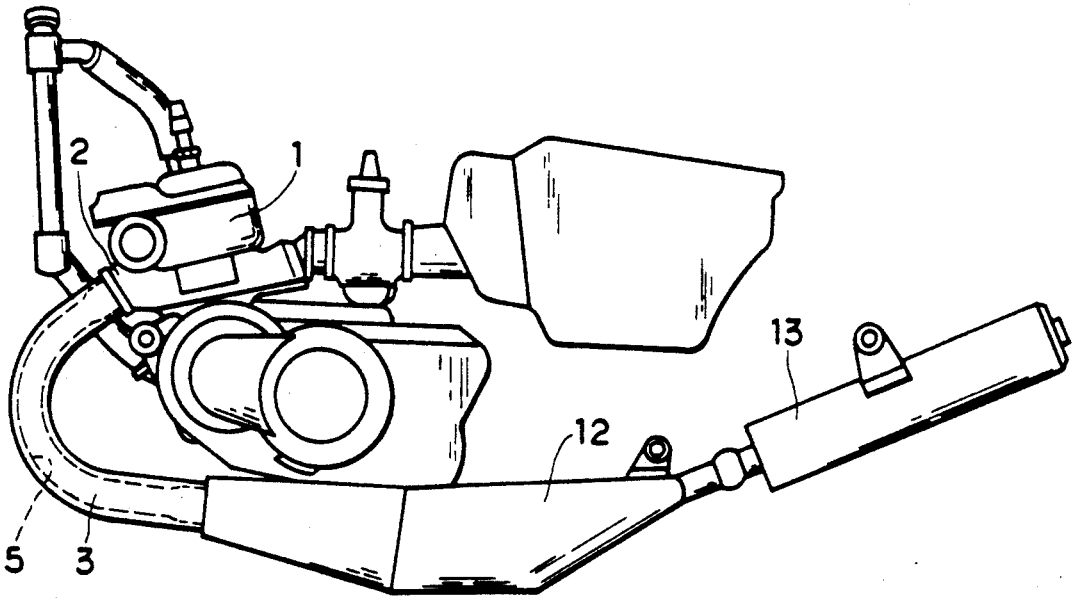
FIG. 1 is a schematic view of an engine unit and associated members including an exhaust pipe of a motorcycle to which the present invention is applied.
Figure 2:
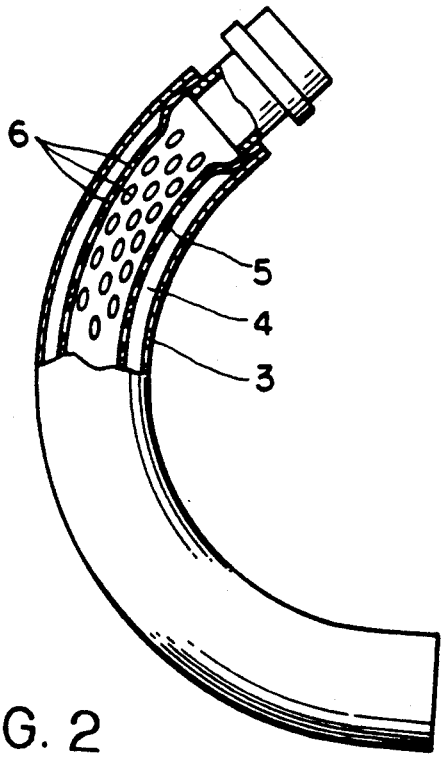
FIG. 2 is an enlarged view of the exhaust pipe, partially in section, shown in FIG. 1.

First, referring to FIG. 1, showing an engine unit and associated elements including an exhaust pipe provided with an exhaust gas cleaning device constructed in accordance with the present invention, an internal combustion engine 1 is provided with an exhaust port 2 for exhausting the exhaust gas from the combustion chamber of the engine 1. To the exhaust port 2 there is coupled an exhaust pipe 3, within which an inner pipe 5 is coaxially disposed with an annular space 4 defined between the inner surface of the exhaust pipe 3 and the outer surface of the inner pipe 5 as shown in FIG. 2. The inner pipe 5 acts as a support member for supporting a catalyst carrier layer which will be described hereinafter. The rear end portion of the exhaust pipe 3 is connected to an expansion chamber 12 having a tubular structure and to which a muffler 13 is connected. The exhaust gas from the exhaust pipe 3 is expanded within the expansion chamber 12, silenced within the muffler 13 and thereafter exhausted from the rear end of the muffler 13.

Figure 3:
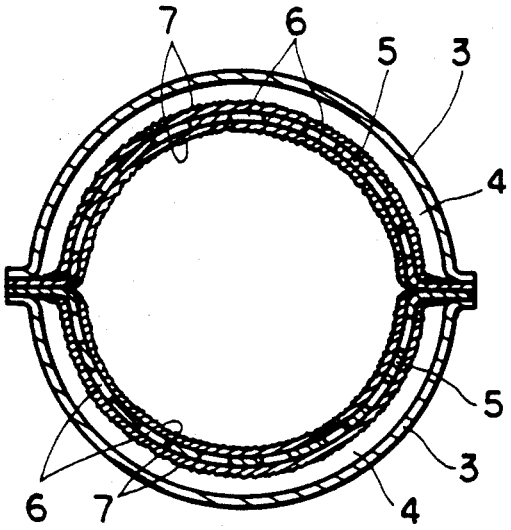
FIG. 3 is a sectional view of the exhaust pipe provided with an exhaust gas cleaning device according to the present invention.
Figure 4:
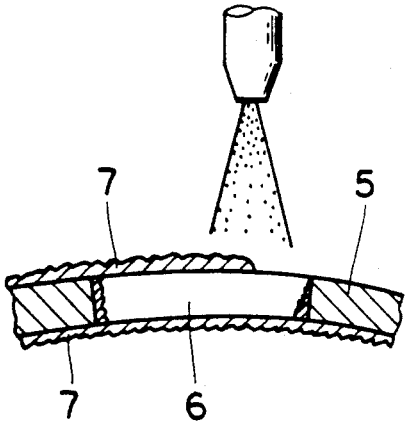
FIG. 4 is a view showing the injection process for forming a laminated structure of the exhaust gas cleaning device of the present invention.
Figure 5:
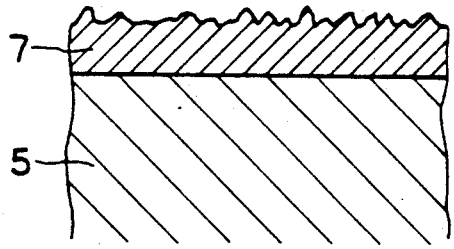
FIGS. 5 to 8 are brief sectional views showing a part of the exhaust gas cleaning device of the present invention, in accordance with which, for example, in FIG. 5, one intermediate layer having an irregular surface is formed, in FIG. 6, two intermediate layers are formed, in FIG. 7, a catalyst carrier layer, before treatment, is formed upon the intermediate layer and in FIG. 8, the catalyst carrier layer, after treatment, is formed upon the intermediate layer.
Figure 6:
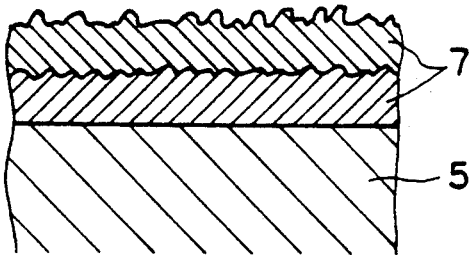
Figure 7:
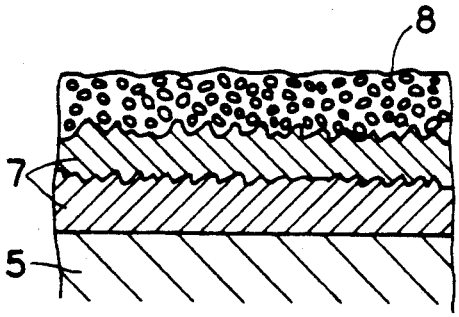
Figure 8:
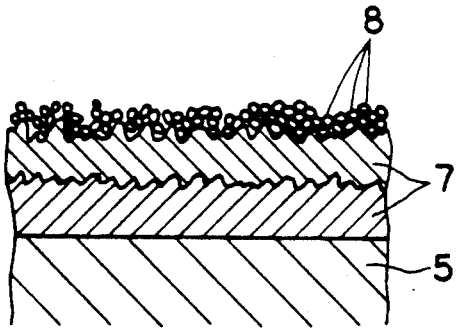

The exhaust pipe 3 and the inner pipe 5 are made from a steel plate or a stainless steel plate, in a preferred embodiment, and as shown in FIG. 3, the exhaust pipe 3 and the inner pipe 5 are formed by means of two portions respectively, each having a semi-circular cross section. These two portions are mated and fused together so as to form the exhaust pipe 3 and the inner pipe 5, which are both circular in cross section. The mated and fused portions of the inner pipe 5 are inserted into the mated portions of the exhaust pipe 3 and are fused integrally therewith. A plurality of perforations 6 are formed within the inner pipe 5 for the purpose of ventilation. As shown in FIGS. 4 to 6, one or two intermediate metal layers such as, for example, alumina, ceramic or cermet having non-detrimental properties with respect to a catalyst are injected upon the inner and outer surfaces of the inner pipe 5 so as to form intermediate irregular surface layers 7 including fine recesses and protrusions. The outer surface of each one of the intermediate irregular surface layers 7 may be formed so as to exhibit coarse surface characteristics by means of grit blasting techniques or by means of rubbing the surface with sand paper, for example. A slurry composed of a catalyst solution and a catalyst carrier made of porous material such as, for example, silica aluminum is adhered to the outer surface of the irregular layer 7 by means of suitable coating techniques, for example, as shown in FIG. 7 and when the thus formed layer is heated so as to dry the same and remove the liquid component therefrom a catalyst carrier layer 8 including the catalyst is formed upon the outer surface of the intermediate layer 7 as shown in FIG. 8.

According to the method described above, since the catalyst is not disposed directly in contact with the outer surface of the inner pipe 5, the degradation of the catalyst due to the deleterious materials comprising the inner pipe 5 can be prevented. In addition, the irregular intermediate layer 7 provides heat insulation properties and, hence, the active temperature of the catalyst can be effectively maintained.

The provision of the intermediate layer 7 can prevent chemical reaction of the inner pipe and prevent the diffusion of metallic ions so as to thereby improve the durability of the inner pipe 5. In addition, the intermediate layer 7 serves to lessen thermal shocks and thermal stresses due to the heat cycles to which the exhaust apparatus is subjected and thereby also serves to maintain the firmly adhered state of the catalyst carrier layer 8. For this purpose, it is desired to select a material for the intermediate layer which has a coefficient of thermal expansion having a value between the coefficients of thermal expansion of the inner pipe 5 and the catalyst carrier layer 8*b*.

The exhaust gas contacts the catalyst carrier layer 8 while flowing within or through the exhaust pipe 3, and the carrier layer 8 carries out the oxidation reaction so as to thereby clean or remove the unburned components within or from the exhaust gas. This effect may be further improved by providing the intermediate irregular layer and the catalyst carrier layer having the characteristics described above upon the inner surface of the exhaust pipe 3. Moreover, the inner pipe 5 has a tubular structure, so that the resistance to the exhaust gas flow is effectively reduced and, hence, the lowering of the output of the engine can be minimized.

Figure 9:
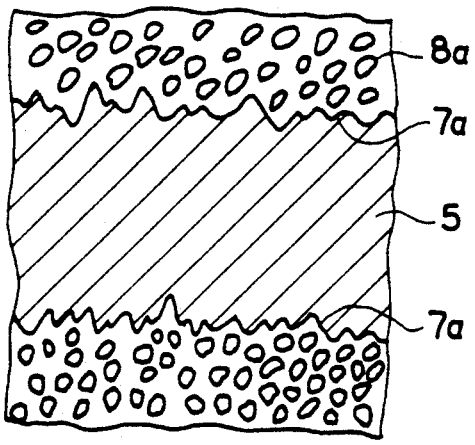
FIGS. 9 and 10 are views similar to those of FIGS. 7 and 8, however, the intermediate layer has been eliminated in accordance with this embodiment of the present invention.
Figure 10:
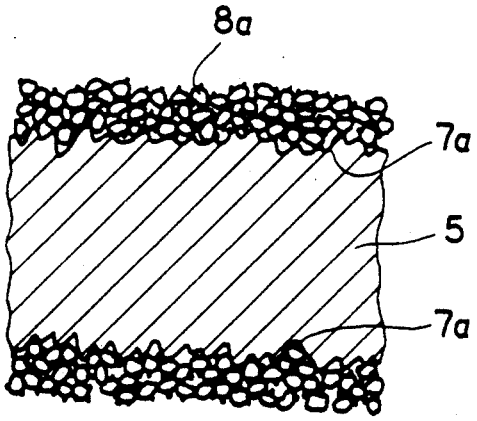

In accordance with an alternative embodiment, as shown in FIG. 9, in which the intermediate layer 7 of the above described embodiment has been eliminated, the outer surface of the inner pipe 5 is formed as an irregular surface 7*a* by means of the grit blasting techniques or by means of rubbing the surface with sand paper, for example so as to provide an irregular surface including fine recessed and protruding portions. In this example, the slurry composed of the catalyst solution and the catalyst carrier made from a porous material such as, for example, silica aluminum is thereafter adhered to the outer surface of the irregular layer 7*a* and thereafter heated so as to dry the same and remove the liquid component, therefrom thus forming the catalyst carrier layer 8*a* upon the outer surface of the irregular layer 7*a* as shown in FIG. 10. Such treatment may be performed in a similar manner with respect to the inner surface of the exhaust pipe 3. In this example, the exhaust gas cleaning device can be simply composed and the unburned components disposed within the exhaust gas can be effectively cleaned, removed, or nullified.

In accordance with another embodiment of the present invention in which intermediate film layers are also formed upon the inner and outer surfaces of the inner pipe 5 disposed inside the exhaust pipe 3 as shown in FIG. 2, catalyst carrier layers are also formed upon the outer surfaces of the intermediate layers.

Figure 11:
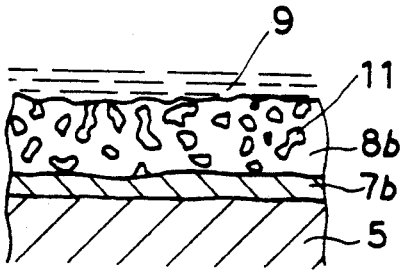
FIGS. 11 and 12 are views similar to those of FIGS. 7 and 8, in which the intermediate layer is formed so as not to provide an irregular surface thereto, that is, the intermediate layer has a regular or substantially smooth surface, according to a further embodiment of the present invention.
Figure 12:
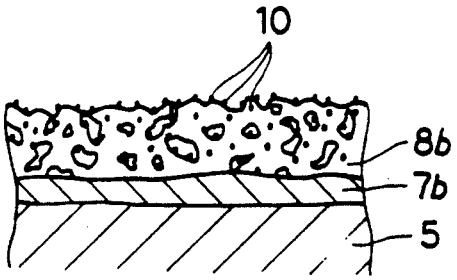

Namely, as shown in FIGS. 11 and 12, intermediate film layers 7*b* are formed by coating metal such as, for example, alumina which has a non-deleterious property with respect to the catalyst, by means of an aluminizing method, upon the inner and outer surfaces of the inner pipe 5. Thereafter, a metallic oxide such as, for example, alumina is injected onto the outer surfaces of the intermediate film layers 7*b* so as to form carrier layers 8*b* including a plurality of holes 11 due to the injection process. The carrier layer 8*b* is then dipped into a catalyst solution 9 as briefly shown in FIG. 11 so as to impregnate the catalyst particles 10 into the carrier layer 8*b*. The thus formed inner pipe 5 is then heated so as to dry the catalyst including the solution layer so as to thereby form the catalyst carrier layer 8*b* as shown in FIG. 12.

The intermediate film layer 7*b* and the catalyst carrier layer 8*b* may also be formed upon the inner surface of the exhaust pipe 3 so as to increase the exhaust gas cleaning effect.

The provision of the intermediate film layer 7*b* may result in attaining or achieving substantially the same effects and functions as those described hereinbefore with reference to the intermediate irregular layer 7, it being noted that in the embodiment of FIGS. 11 and 12, the layers 7*b* are regular or smooth and not irregular as shown in the embodiments of FIGS. 5–8.

Figure 13:
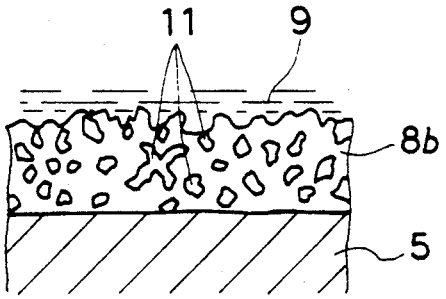
FIGS. 13 and 14 are views similar to those of FIGS. 9 and 10, and according to a further embodiment of the present invention, in which an intermediate layer is not formed upon the inner pipe of the exhaust pipe, and the interface defined between the inner pipe and the carrier layer is smooth or regular.
Figure 14:
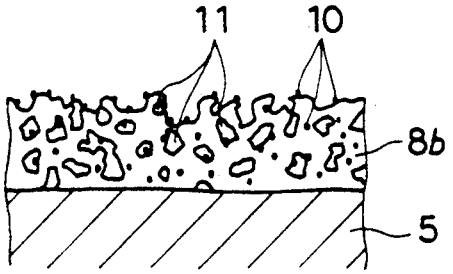

In accordance with an alternative embodiment, the intermediate layer 7*b* of FIGS. 11 and 12 may be eliminated as shown in FIGS. 13 and 14. In this embodiment, although the positive characteristics of the cleaning device as a result of the provision of the intermediate film layer 7*b* may be eliminated, the unburned components of the exhaust gas can nevertheless be effectively cleaned or removed.

In the foregoing embodiments, the density of the catalyst can be optionally selected by properly preparing the catalyst including the solution therefor.

Figure 15:
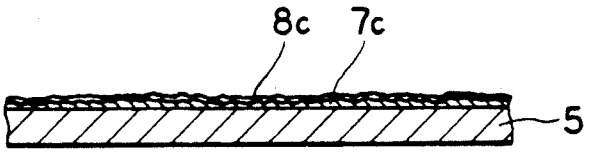
FIG. 15 is a view similar to that shown in FIG. 12 and according to a further embodiment of the present invention in which alumina is used as the intermediate catalyst carrier layer.

In accordance with a further embodiment of the present invention, as shown in FIG. 15, metallic oxide such as, for example, alumina is injected onto the inner and outer surfaces of the inner pipe 5 disposed within the exhaust pipe 3 so as to form intermediate layers 7*c* as catalyst carrier layers. Catalyst agents 8*c* are then adhered, by means of a coating method, for example, to the outer surface of each one of the intermediate layers 7c so as to support the catalyst agent 8c within the device. In this embodiment, the exhaust gas flowing within the exhaust pipe 3 contacts the catalyst agent 8c so as to thereby carry out the oxidation reaction, thus removing the unburned components from the exhaust gas so as to effectively clean the same.

Obviously, many modifications and variations of the present invention are possible in light of the above teachings. It is therefore to be understood that within the scope of the appended claims, the present invention may be practiced otherwise than as specifically described herein.

What is claimed is:

1. An exhaust gas system for an internal combustion engine, comprising:

an exhaust pipe open at one end thereof and connected at said one end thereof to an exhaust port of said internal combustion engine for receiving exhaust gases discharged from said internal combustion engine, and open at an opposite end thereof for discharging said exhaust gases away from said internal combustion engine;

an inner pipe disposed coaxially within said exhaust pipe with an annular space defined between an outer surface of said inner pipe and an inner surface of said exhaust pipe, said inner pipe being open at a first end thereof and connected at said first end thereof to said exhaust port of said internal combustion engine for receiving said exhaust gases discharged from said internal combustion engine, and being open at a second end thereof for discharging said exhaust gases away from said internal combustion engine, said inner pipe also being provided with a plurality of perforations within sidewall portions thereof for providing fluidic communication between said inner pipe and said annular space defined between said inner pipe and said exhaust pipe; and layer structures disposed upon inner and outer surfaces of said inner pipe and including a catalyst for cleaning unburned components of said exhaust gases flowing axially within said exhaust pipe and said inner pipe between said one and opposite ends of said exhaust pipe and between said first and second ends of said inner pipe, each of said layer structures being formed of a material which is non-deleterious to said catalyst.

2. An exhaust gas system according to claim 1, wherein:

each one of said layer structures includes first layers formed of a material which is non-deleterious to said catalyst upon said inner and outer surfaces of said inner pipe, and second layers formed upon outer surfaces of said first layers and comprising catalyst carrier layers formed by fusibly injecting a slurry, composed of a catalyst solution and a catalyst carrier, upon said outer surfaces of said first layers, and drying said injected slurry so as to remove a liquid component therefrom.

3. An exhaust gas system according to claim 2 wherein each of said first layers is composed of two layer components.

4. An exhaust gas system according to claim 2, wherein the material of the first layer is alumina.

5. An exhaust gas system according to claim 2, wherein the material of the first layer is ceramic or cermet.

6. An exhaust gas system according to claim 2, wherein the outer surface of the first layer is formed so as to exhibit an irregular surface provided with recessed and protruding portions.

7. An exhaust gas system according to claim 1, wherein said layer structure is further formed upon an inner surface of the exhaust pipe.

8. An exhaust gas system according to claim 1, wherein:

said inner and outer surfaces of said inner pipe are formed so as to exhibit irregular surfaces provided with recessed and protruding portions; and said layer structures are formed of catalyst carrier layers upon said irregular inner and outer surfaces of said inner pipe by fusibly injecting a slurry, composed of catalyst solution and a catalyst carrier, upon said irregular inner and outer surfaces of said inner pipe, and drying said injected slurry so as to remove a liquid component therefrom.

9. An exhaust gas system according to claim 8, wherein said layer structures are further formed upon an inner surface of said exhaust pipe.

10. An exhaust gas system for an integral combustion engine, comprising:

an exhaust pipe open at one end thereof and connected at said one end thereof to an exhaust port of said integral combination engine for receiving exhaust gases discharged from said internal combustion engine, and open at an opposite end thereof for discharging said exhaust gases away from said internal combustion engine;

an inner pipe disposed coaxially within said exhaust pipe with an annular space defined between an outer surface of said inner pipe and an inner surface of said exhaust pipe, said inner pipe being open at a first end thereof and connected at said first end thereof to said exhaust port of said internal combustion engine for receiving said exhaust gases discharged from said internal combustion engine, and being open at a second end thereof for discharging said exhaust gases away from said internal combustion engine, said inner pipe also being provided with a plurality of perforations within sidewall portions thereof for providing fluidic communication between said inner pipe and said annular space defined between said inner pipe and said exhaust pipe; and layer structures disposed upon inner and outer surfaces of said inner pipe and including a catalyst for cleaning unburned components of said exhaust gases flowing axially within said exhaust pipe and said inner pipe between said one and opposite ends of said exhaust pipe and between said first and second ends of said inner pipe;

each one of said layer structures comprising an intermediate film layer which is non-deleterious to said catalyst and being formed upon said inner and outer surfaces of said inner pipe, and a catalyst carrier layer formed upon an outer surface of said intermediate film layer by fusibly injecting a metallic oxide upon said outer surface of said intermediate film layer so as to form a carrier layer, impregnating a catalyst solution into said carrier layer, and drying said catalyst-impregnated carrier layer so as to remove a liquid component therefrom thereby forming said catalyst carrier layer upon said intermediate film layer.

11. An exhaust gas system according to claim 10, wherein the metallic oxide is alumina.

12. An exhaust gas system according to claim 10, wherein said layer structure is further formed upon an inner surface of said exhaust pipe.

13. An exhaust gas system for an internal combustion engine, comprising:

an exhaust pipe open at one end thereof and connected at said one end thereof to an exhaust port of said internal combustion engine for receiving exhaust gases discharged from said internal combustion engine, and open at an opposite end thereof for discharging said exhaust gases away from said internal combustion engine;

an inner pipe disposed coaxially within said exhaust pipe with an annular space defined between an outer surface of said inner pipe and an inner surface of said exhaust pipe, said inner pipe being open at a first end thereof and connected at said first end thereof to said exhaust port of said internal combustion engine for receiving said exhaust gases discharged from said internal combustion engine, and being open at a second end thereof for discharging said exhaust gases away from said internal combustion engine, said inner pipe also being provided with a plurality of perforations within sidewall portions thereof for providing fluidic communication between said inner pipe and said annular space defined between said inner pipe and said exhaust pipe; and layer structures disposed upon inner and outer surfaces of said inner pipe and including a catalyst for cleaning unburned components of said exhaust gases flowing axially within said exhaust pipe and said inner pipe between said one and opposite ends of said exhaust pipe and between said first and second ends of said inner pipe;

each one of said layer structures comprising catalyst carrier layers including a plurality of holes and being formed upon said inner and outer surfaces of said inner pipe by fusibly injecting a metallic oxide upon said inner and outer surfaces of said inner pipe so as to form carrier layers which include said holes, impregnating a catalyst solution into said carrier layers, and drying said catalyst-impregnated carrier layers so as to remove a liquid component therefrom thereby forming said catalyst carrier layers upon said inner and outer surfaces of said inner pipe.

14. An exhaust gas system according to claim 13, wherein the metallic oxide is alumina.

15. An exhaust gas system according to claim 13, wherein said layer structure is further formed upon an inner surface of said exhaust pipe.

16. An exhaust gas system for an internal combustion engine, comprising:

an exhaust pipe open at one end thereof and connected at said one end thereof to an exhaust port of said internal combustion engine for receiving exhaust gases discharged from said internal combustion engine, and open at an opposite end thereof for discharging said exhaust gases away from said internal combustion engine;

an inner pipe disposed coaxially within said exhaust pipe with an annular space defined between an outer surface of said inner pipe and an inner surface of said exhaust pipe, said inner pipe being open at a first end thereof and connected at said first end thereof to said exhaust port of said internal combustion engine for receiving said exhaust gases discharged from said internal combustion engine, and being open at a second end thereof for discharging said exhaust gases away from said internal combustion engine, said inner pipe also being provided with a plurality of perforations within sidewall portions thereof for providing fluidic communication between said inner pipe and said annular space defined between said inner pipe and said exhaust pipe;

layer structures disposed upon inner and outer surfaces of said inner pipe, said layer structures comprising carrier layers formed by fusibly injecting alumina upon said inner and outer surfaces of said inner pipe; and catalyst means adhered upon outer surfaces of said carrier layers.

17. An exhaust gas system according to claim 16, wherein said layer structure is further formed upon an inner surface of said exhaust pipe.

* * * * *

UNITED STATES PATENT AND TRADEMARK OFFICE

CERTIFICATE OF CORRECTION

PATENT NO. : 5,151,254

DATED : Sept. 29, 1992

INVENTOR(S) : Hideki Arai et al.

It is certified that error appears in the above-identified patent and that said Letters Patent is hereby corrected as shown below:

Claim 8, col. 8, line 16, before "catalyst" (first occurrence) insert --a--.

Claim 10, col. 8, line 23, change "integral" to --internal--;

line 27, change "integral combination" to --internal combustion--.

Signed and Sealed this

Seventh Day of September, 1993

Bruce Lehman

*Attest:*

BRUCE LEHMAN

*Attesting Officer*

*Commissioner of Patents and Trademarks*